United States Patent [19]

Ishii

[11] Patent Number: 4,702,470

[45] Date of Patent: Oct. 27, 1987

[54] PAPER SUPPLYING DEVICE FOR PERFECTING PRINTING MACHINE

[75] Inventor: Koji Ishii, Hiroshima, Japan

[73] Assignee: Ryobi Ltd., Hiroshima, Japan

[21] Appl. No.: 815,306

[22] Filed: Dec. 30, 1985

Related U.S. Application Data

[63] Continuation-in-part of Ser. No. 734,249, May 14, 1985, abandoned, which is a continuation of Ser. No. 497,975, May 25, 1983, abandoned.

[30] Foreign Application Priority Data

May 31, 1982 [JP] Japan ..... 57-81203[U]

[51] Int. Cl.[4] ..... B65H 9/14; B41F 13/24

[52] U.S. Cl. ..... 271/229; 271/246; 271/277; 101/232; 101/408

[58] Field of Search ..... 271/245, 246, 229, 230, 271/277, 275; 101/232, 408

[56] References Cited

U.S. PATENT DOCUMENTS

| | | | |
|---|---|---|---|
| 1,603,349 | 10/1926 | Marquardt | 271/229 |
| 2,753,184 | 7/1956 | Backhouse | 271/231 |
| 2,856,188 | 10/1958 | Crittenden | 271/230 |
| 2,984,482 | 5/1961 | Kist et al. | 271/246 X |
| 3,593,989 | 7/1971 | Crittenden | 271/263 X |
| 3,630,519 | 12/1971 | Spear | 271/246 |

FOREIGN PATENT DOCUMENTS

| | | |
|---|---|---|
| 471089 | 2/1929 | Fed. Rep. of Germany . |
| 482624 | 9/1929 | Fed. Rep. of Germany . |
| 986381 | 3/1965 | United Kingdom . |
| 1329747 | 9/1973 | United Kingdom . |

*Primary Examiner*—Joseph J. Rolla
*Assistant Examiner*—Gregory L. Huson
*Attorney, Agent, or Firm*—Sughrue, Mion, Zinn, Macpeak, and Seas

[57] ABSTRACT

A printing device is provided with a paper insertion mechanism including a paper stop and a pair of paper driving rolls operable in association with the rotation of a printing cylinder which includes an actuating cam. A paper presser operates synchronously with printing operation to press the paper against a paper guide during printing to impart tension to the paper to prevent transverse movement thereof.

1 Claim, 3 Drawing Figures

PAPER SUPPLYING DEVICE FOR PERFECTING PRINTING MACHINE

This is a continuation-in-part of application Ser. No. 734,249 filed May 14, 1985, which is a continuation of application Ser. No. 497,975 filed May 25, 1983 both abandoned.

BACKGROUND OF THE INVENTION

The present invention relates to a paper supplying device for a perfecting printing machine.

In general, the paper supplying mechanism in a perfecting printing machine is composed of a feed mechanism and a paper insertion portion. A cam lever is actuated in conjunction with the operation of inserting a cylinder by means of a cam fixedly provided at one side of a first rubber cylinder in the conventional paper inserting portion, so that a stop finger is lowered to release the regulation of the paper, and at the same time, an upper roll is lowered to come into contact with a lower roll which is rotatably driven, so that the paper is sent between the first rubber cylinder and a second rubber cylinder, which also operates as an impression cylinder, or a gripper at a chain delivery portion fitted into the opening part thereof grips the paper directly so as to transfer the same in relation to the rotation of the first rubber cylinder, thereby effecting perfecting printing of the paper.

However, since the paper inserting portion releases the forced feeding of the paper after the paper has been sent between the two cylinders as mentioned above (the same is also true in the case where a gripper grips the paper) in the conventional device, the paper flaps, for example, upwards and downwards in the vicinity of the portion in front of the printing location at the time when the paper is sent between the first rubber cylinder and the second rubber cylinder, so that the flow thereof becomes unstable. As a consequence, there is a drawback in that the portion which is at the position in front of the printing location comes into contact with both the rubber cylinders so as to bring about a doubling phenomenon such that the printed image becomes doubled.

SUMMARY OF THE INVENTION

The invention pertains to a paper inserting mechanism for a printing device for controlling the regulation and the tension of a paper to be printed in order to reduce the likelihood of a doubled image due to movement of the paper being printed.

DETAILED EXPLANATION OF THE PREFERRED EMBODIMENTS

Figure 1:
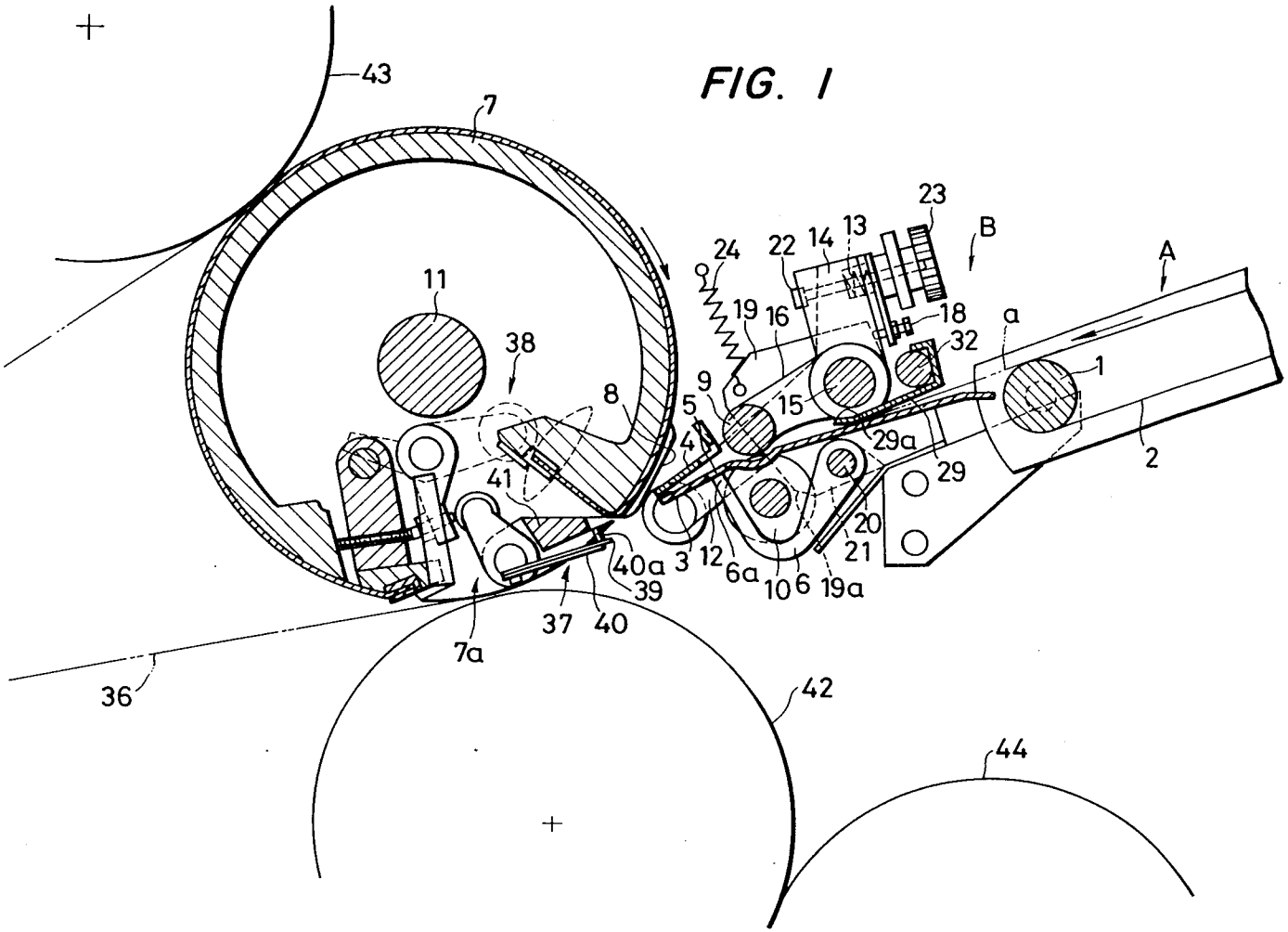
FIG. 1 is a side view in longitudinal cross section showing one embodiment of the paper supplyng device for a perfecting printing machine in accordance with the present invention.

The paper supplying device of the present invention is composed of a feed mechanism A and a portion B for the paper insertion, as shown in FIG. 1.

The feed mechanism A is composed of rollers 1 and a belt 2, so that papers are fed to the portion B from a paper supply portion (not shown).

Figure 2:
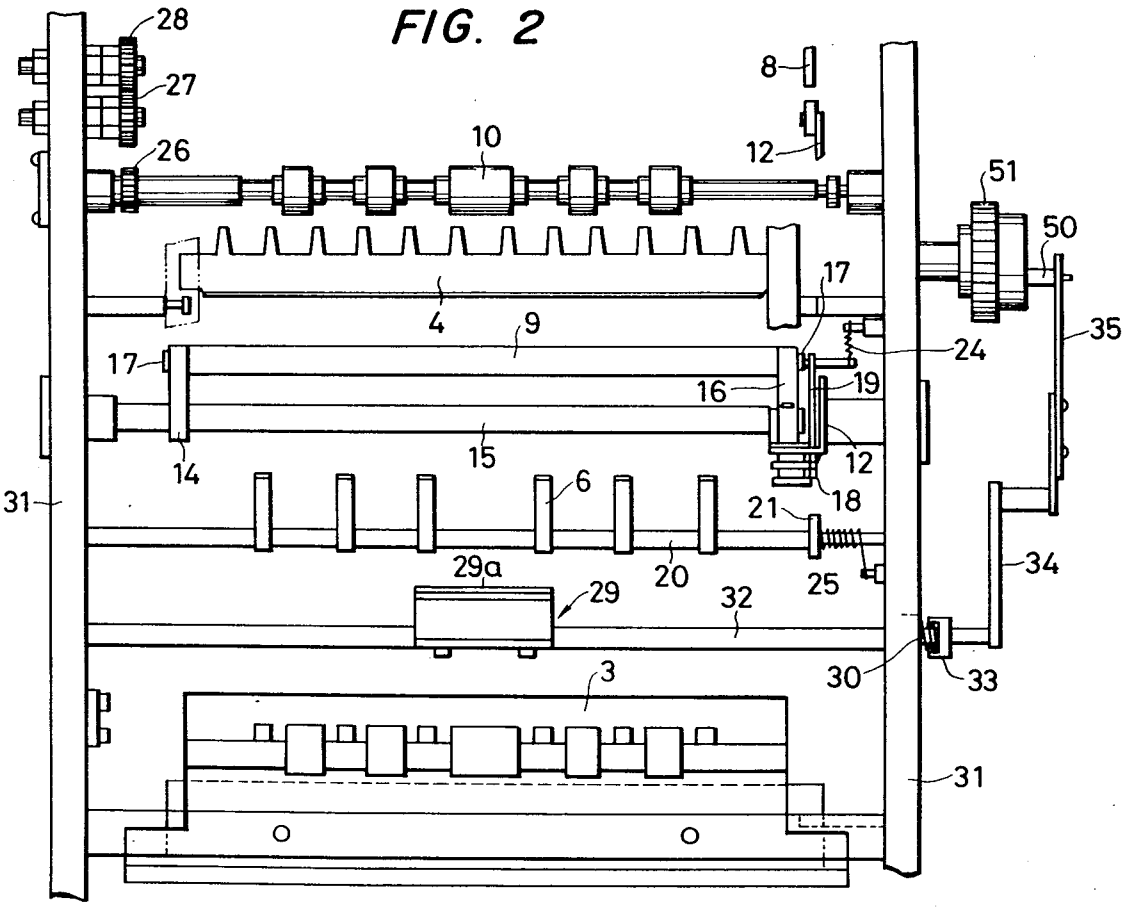
FIG. 2 is an unfolded plan view of the device of FIG. 1.

The insertion portion B is constituted as hereinafter described. As shown in FIGS. 1 and 2, there are provided a lower paper guide 3 and an upper paper guide 4 which guide a paper (a). A stop finger 6 is provided such that its end 6*a* projects upwardly from a through-hole 5 formed in the lower paper guide 3, so as to temporarily regulate the paper. If the stop finger 6 is swung downwardly in a manner as described hereafter by the function of a cam 8 fixedly provided at one side of a first rubber cylinder 7, the regulation of the paper is released, and at the same time, an upper roll 9 also becomes lowered so as to come into contact with a lower roll 10, thereby delivering the paper (a).

In other words, if the cam 8 rotates in the direction indicated by the arrow in FIG. 1 in conjunction with the shaft of the first rubber cylinder and the cam lever 12 comes into contact therewith so as to rotate anticlockwise, compression spring 13 is compressed so that arm 14 is rotated anticlockwise.

The cam lever 12 is idly fitted to a shaft 15, and the arms 14 and 16 are fixed to the shaft 15. The upper roll 9 is mounted so as to be rotatably supported by the arms 14, 16 at its ends by means of a pin 17. A bolt 18 is fixed to the cam lever 12. If the end of the bolt 18 is pushed against the end of the lever 19, which is idly fitted to the shaft 15, and turned, the lever 19 is rotated anticlockwise with the shaft 15 as a support point, so as to move cam 21 fixed to shaft 20 anticlockwise with its end 19*a*, and move the stop finger 6, which is fixedly mounted to the shaft 20, anticlockwise, thereby releasing the regulation of the paper.

In other words, the bolt 18 adjusts the device such that the end 6*a* of the stop finger 6 is positioned at least beneath the upper surface of the lower paper guide 3 at the time when the upper roll 9 comes into contact with the lower roll 10.

In addition, a screw 22 is fixed at one end of the arm 14, and a knob 23 is rotatably mounted at one end of the screw 22. A plate spring (not shown) is elastically engaged at one end, the other end being fixed to the arm 14, so that the rotation of knob 23 is elastically regulated by means of the plate spring.

Since the amount of rotation of the lever 19 due to the engagement of the cam lever 12 and the cam 8 is varied if the knob 23 is turned, the period of time of contact with the lower roll 10 due to the lowering of the upper roll 9 is adjusted.

This adjustment plays the role of a timing adjustment in respect to the opening and closing of a gripper as described hereafter.

The lever 19 is provided in such a way as to return due to the elasticity of the spring 24 if the cam lever 12 disengages the cam 8, and the stop finger 6 also returns due to the force of a torsion spring 25 which is mounted on shaft 20, so as to project from the through-hole 5 formed in the lower paper guide 3, so as to be prepared to temporarily regulate the next paper.

In addition, the lower roll 10 is provided with a gear 26 at one end thereof, and the gear 26 engages a gear (not shown) additionally provided on the first rubber cylinder 7 via idler gears 27, 28, so that the lower roller 10 rotates as the first rubber cylinder 7 is driven to rotate.

A paper pressing member 29 is supported by means of a shaft so as to swing upwardly and downwardly and provide a paper pressing force by a torsion spring 30, so as to press the paper (a) with the end 29*a*. Thus, the paper (a) is pressed against the lower paper guide 3 in the vicinity of the upper roll 9. The paper pressing member 29 is coupled to the desired mechanism in the printing machine such that it moves downwards in conjunction with the printing operation to press the paper (a) and upwards against the force of the spring 30 in synchronism with the finish of printing.

In particular, the paper pressing member 29 is provided such that the end thereof is fixed to a shaft 32 which is rotatably provided on a pair of frames 31, 31 as shown in FIG. 2, and one end of the torsion spring 30, which is mounted on the shaft 32, is in engagement with the frame 31 and the other end is in engagement with a collar 33 or the like which is fixed to the end of the shaft, thereby providing the paper pressing force.

As the mechanism operable in conjunction with the printing operation, for example, it is acceptable to provide the shaft 32 in conjunction with a fountain roll actuation mechanism actuated so as to detect the supply of paper via an arm 34, a link 35 and the like. The mechanism and means in conjunction therewith may be arbitrarily chosen.

The paper feed means in the example shown in the drawings is constituted as follows. A pair of sprockets (not shown) are provided at both ends of the first rubber cylinder 7. A pair of chains 36, 36 are provided around these sprockets and other sprockets (not shown) provided at the side of the paper discharging portion. There is provided a gripper 37 fitted into an opening 7*a* of the first rubber cylinder 7 between the chains 36, 36. On the other hand, a mechanism 38 is provided to open and close the gripper.

Figure 3:
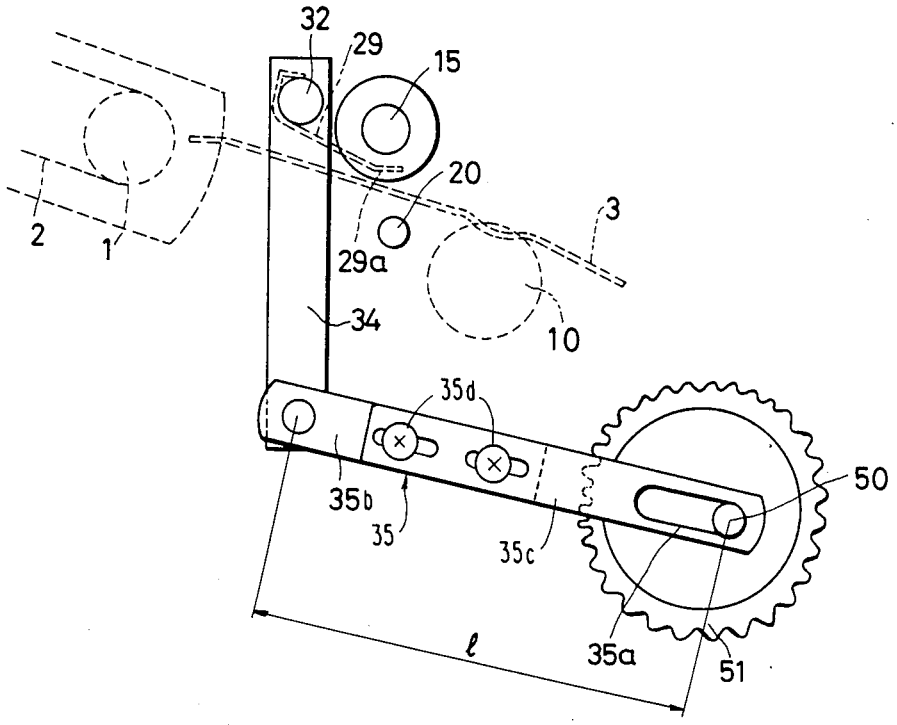
FIG. 3 is a partial side view as viewed from a direction opposite to FIG. 1.

In FIG. 3, the shaft 32 is fixed to one end of the arm 34, and a crank pin 50 is fixed to a side surface of a gear 51 at a position offset from its axis. The gear 51 is rotated in synchronism with the rubber cylinder 7. The shaft 32 is rotated by a predetermined angle by the rotation of the gear 51 through the crank pin 50 and the link 35 pivotably connected to the otherend of the arm 34. The link 35 is formed with a slot 35*a* at one end thereof so as to lift the paper pressing member 29 by a predetermined angle in response to a single rotation of the rubber cylinder 7. That is, the paper pressing member 29 is arranged so as to permit its end 29*a* to press the paper during the period starting from the holding of the tip end of the sheet by the gripper 37 and to the completion of passing of the sheet end through the end 29*a*.

It is possible to control the period during which the paper pressing member 29 presses the paper guide means 3 and the paper, by changing the length l in the link 35 shown in FIG. 3. The length l can be changed by adjusting the screws 35*d* and 35*d* those being adapted to secure left and right sides 35*b* and 35*c* of the link.

Hence, the paper (a) which is fed by means of the paper feed mechanism A is temporarily regulated by the end 6*a* of the stop finger 6 so that the printing timing is adjusted. If the temporary regulation by the stop finger 6 is released by the engagement of the cam 8 and the cam lever 12, and, at the same time, the upper roller 9 comes into contact with the lower roller 10 such that the paper (a) is clasped therebetween, the paper is sent out from the paper guides 3, 4 by the lower roller 10, which is driven so as to rotate. At this time, the gripper 37 is fitted into the opening 7*a* of the first rubber cylinder 7. A gripper piece 39 and a paper stop 40 are actuated to move with respect to a gripper base 41 by the mechanism 38, so that the paper (a) is inserted between the gripper piece 39 and the gripper base 41. As a result, the end of the paper (a) comes into contact with a stop piece 40*a* of the paper stop 40 and is thus positioned. Then, the gripper piece 39 and the paper stop 40 are closed, by the mechanism 38, so that the paper (a) is gripped and fixed.

Since the chains 36, 36 are also rotated if the first rubber cylinder 7 is driven to rotate, the paper (a) gripped by the gripper 37 is sent between the first and second rubber cylinders 7, 42 so that a perfecting printing operation is effected thereon. The paper is then transferred to the paper discharge side as it is. There, the gripper piece 39 and the paper stopper 40 are opened by the mechanism 38, thereby discharging the printed paper onto a discharge table (not shown).

When the paper (a) is gripped and fixed by means of the gripper 37 as described above, the upper roller 9 moves upwardly by the function of the cam 8. Paper feeding is dependent upon the gripper 37, and the paper is fed and printed as described above. The paper pressing member 29 is synchronizedly lowered so that the paper (a) is pressed on the lower paper guide 3. Thus, the paper (a) is transferred by means of the gripper 37 while being pressed by means of the paper pressing member 29. The pressing of the paper is effected until the paper (a) has passed, and the paper pressing member 29 then returns upwardly and is prepared for the passage of the next paper.

In FIG. 1, reference numeral 43 denotes a first printing cylinder and reference numeral 44 denotes a second printing cylinder.

In accordance with the paper supplying device of the present invention as described above, since the paper pressing member 29 moves downwardly in connection with the printing operation so that the paper (a) is pressed on the lower paper guide 3, and, in this state, printing is continued at the time when the paper (a) is sent from insertion portion B, so that the paper is directly clasped between the first and second rubber cylinders 7, 42 or gripped by the gripper 37, the paper (a) is pressed on the lower paper guide 3 by the paper pressing member 29 when printing is effected and, in this state, the paper is transferred by means of the gripper and the like, thereby making it possible for the paper to be always kept under tension, so that the flow of the paper is made stable. Thus, it becomes possible prevent the doubling phenomenon of conventional means which is caused by the flapping of the paper at the position in front of the printing location, thereby making it possible to enhance printing performance in comparison with the conventional means. In addition, it is possible to easily assemble the paper pressing member 29 into insertion portion B. Since it is not required to largely modify the conventional insertion portion, the size of the device does not become large, and thus it is possible to manufacture it at a low cost.

What is claimed is:

1. A paper supply device, comprising:

an upper roll supported by a shaft and being movable to engage a lower rotatable roll, paper guide means having an exit situated forwardly of said rolls, and paper pressing means located rearwardly of said rolls and movable so as to pressingly engage a driven paper;

cam follower means associated with said upper roller so that said upper roller engages said lower roller for driving a paper when said cam follower engages a cam;

printing means following said exit and including gripper means for gripping an end of said paper, said gripper means being fitted in an opening of a printed cylinder, said cylinder being provided with said cam at a periphery thereof;

said paper pressing means being operated synchronously with a printing operation so as to impart tension to said paper during printing;

said paper pressing means being always urged toward said paper guide means by a spring;

said paper pressing means being operated by a rotation of a shaft extending between a pair of spaced-apart frames of said paper supply device, and said shaft being connected to a rubber cylinder through link means and being rotatable by a predetermined angle in response to a rotation of the rubber cylinder; and further comprising adjusting means for adjusting the length of said link means and, thereby, the period during which said pressing means engages said paper; and further comprising gear means, rotating in synchronism with said rubber cylinder, for driving said link means; and wherein said link means comprises a first link portion coupled to said shaft, extending between said frames, a second link portion eccentrically coupled to said gear means, said first and second link portions being co-linear and having respective linearly extending slots therein, and further comprising releasable fastening means extending through said slots for adjusting the length of said link means.

* * * * *